US008662031B2

(12) United States Patent
Pattakos et al.

(10) Patent No.: US 8,662,031 B2
(45) Date of Patent: Mar. 4, 2014

(54) UNIFLOW PORTLESS TWO-STROKE ENGINE

(76) Inventors: Manousos Pattakos, Nikea Piraeus (GR); Paraskevi Pattakou, Nikea Piraeus (GR); Efthimios Pattakos, Nikea Piraeus (GR); Emmanouel Pattakos, Nikea Piraeus (GR)

( * ) Notice: Subject to any disclaimer, the term of this patent is extended or adjusted under 35 U.S.C. 154(b) by 0 days.

(21) Appl. No.: 13/571,362

(22) Filed: Aug. 10, 2012

(65) Prior Publication Data

US 2013/0037010 A1 Feb. 14, 2013

(30) Foreign Application Priority Data

Aug. 10, 2011 (WO) ..... PCT/IB2011/053569
Sep. 29, 2011 (GB) ..... 1116751.7

(51) Int. Cl.
*F02B 25/00* (2006.01)

(52) U.S. Cl.
USPC ..... 123/73 AV; 123/65 R; 123/74 A

(58) Field of Classification Search
USPC ..... 123/47 R, 73 AV, 74 A
See application file for complete search history.

(56) References Cited

U.S. PATENT DOCUMENTS 2,327,645 A * 8/1943 Hughes ..... 123/47 R
4,791,892 A * 12/1988 Hall ..... 123/47 R

* cited by examiner

*Primary Examiner* — Thanh Truong
*Assistant Examiner* — Tea Holbrook

(57) ABSTRACT

Uniflow two-stroke engines without ports on the cylinder and with four-stroke lubrication.

13 Claims, 14 Drawing Sheets

UNIFLOW PORTLESS TWO-STROKE ENGINE

An object of this invention is to apply the four-stroke trunk piston engine cylinder lubrication to the two-stroke crosshead engines, i.e. to over-lubricate the cylinder liner, apply an oil scraper ring, and then collect the surplus oil, clean it and recycle it.

The claim is to increase the scuffing resistance and to achieve the same low specific oil consumption as on the four-stroke trunk piston engines.

The cylinder lubrication of the slow-speed two-stroke engines is a "once through" or "total loss" system. Once the cylinder oil has left the lubricating device it is virtually "lost", which means the dosage of the cylinder oil is crucial. The cylinder oil is partly lost to the combustion space where it is burned, and partly to the piston underside space as sludge. The two-stroke crosshead engine has no connection between the piston underside space with the oil pan.

In comparison, in the four-stroke trunk piston engine the cylinder liner is virtually over-lubricated with an oil scraper ring on the piston scraping the surplus oil back to the oil pan. The cylinder lubricating oil of the four-stroke trunk piston engine is identical to the engine system oil used for bearing lubrication and cooling purposes; a small amount of the cylinder lubricating oil bypasses the piston rings and ends up in the combustion space, where it is consumed; however the piston has an oil scraper ring that scrapes most of the oil supplied to the cylinder liner back to the engine's oil pan, from where it is drained, cleaned and recycled.

FIG. 1 shows the state of the art.

FIG. 2 shows an engine according a first embodiment. The cylinder liners are sliced. Three of the pistons are sliced, too. One piston is at the TDC. The next two pistons are at the middle stroke, the one performing the compression, the other performing the expansion. The fourth piston is at the BDC with the intake and the exhaust valves open; compressed air from the plenum scavenges the cylinder. Each piston surrounds its own shell/"pants". The connecting rods and the crosshead move between the pant-legs. The crosshead slippers move along crosshead guides. The intake plenum is shown behind the pants. The engine casing and the crosshead guides are not shown.

In FIGS. 2 to 5 the oil scraper is referred as 70, the wrist pin is referred as 71, the set of piston rings is referred as 72.

Figure 1:
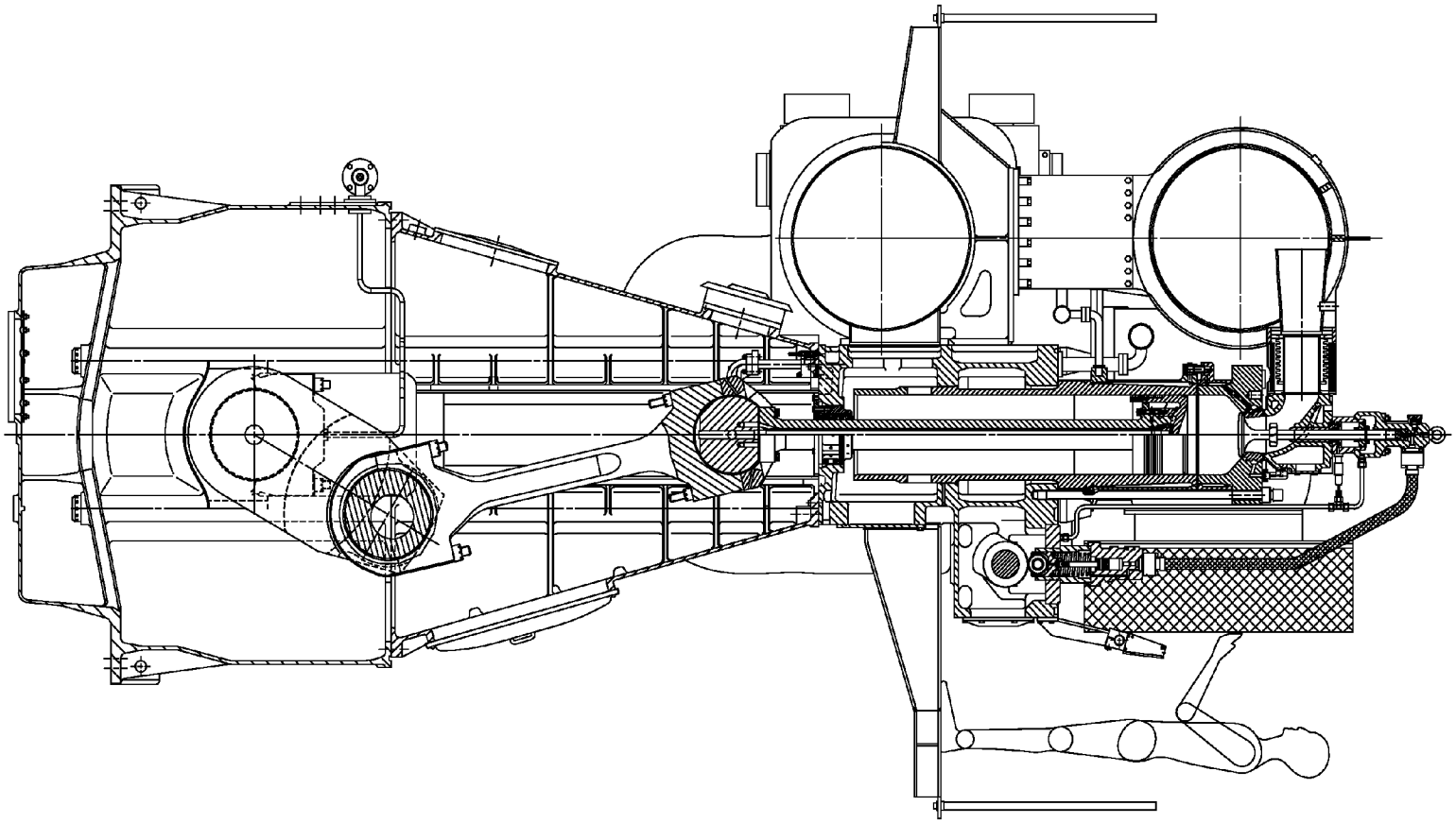
Prior Art Fig 1

FIG. 1 shows the current state-of-the-art slow-speed two-stroke, marine and power plant, engine architecture used in the largest reciprocating engines like the Sulzer RT, the MAN S etc. The stroke is several times longer than the bore. The piston comprises a piston crown and a piston rod. The piston crown comprises piston rings. The piston rod connects the piston crown to a crosshead. There is no connection between the piston underside space with the oil pan. A connecting rod connects the crankpin of the crankshaft to the crosshead. An exhaust poppet valve at the top end of the combustion chamber, and intake ports around the lower end of the cylinder liner, control the breathing of the engine. A charger feeds a plenum surrounding the intake ports with compressed air. The cylinder oil is supplied from external, separate cylinder lubricating device via quills in the cylinder liner; the dosage of the cylinder oil is crucial.

Figure 2:
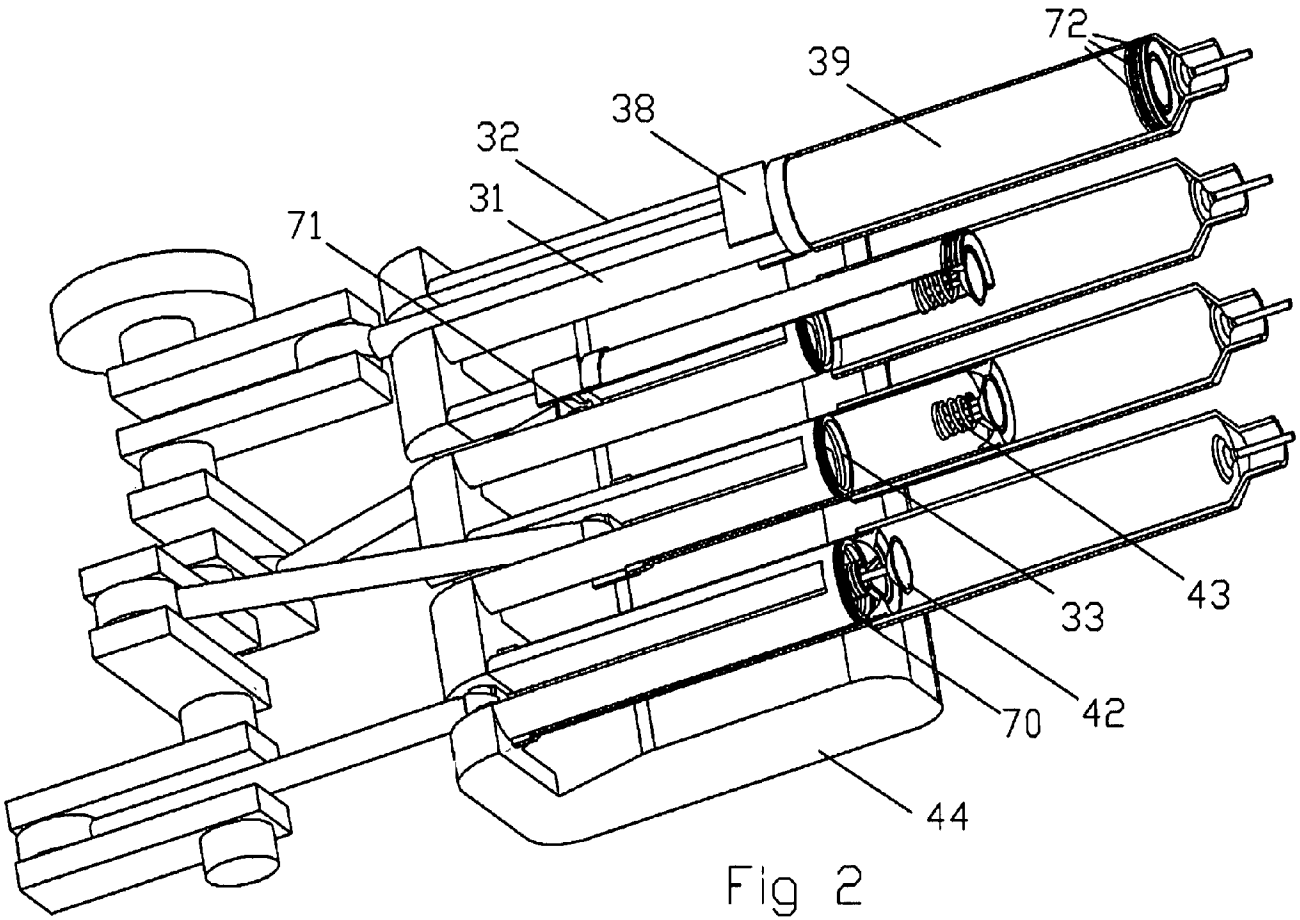
Figure 3:
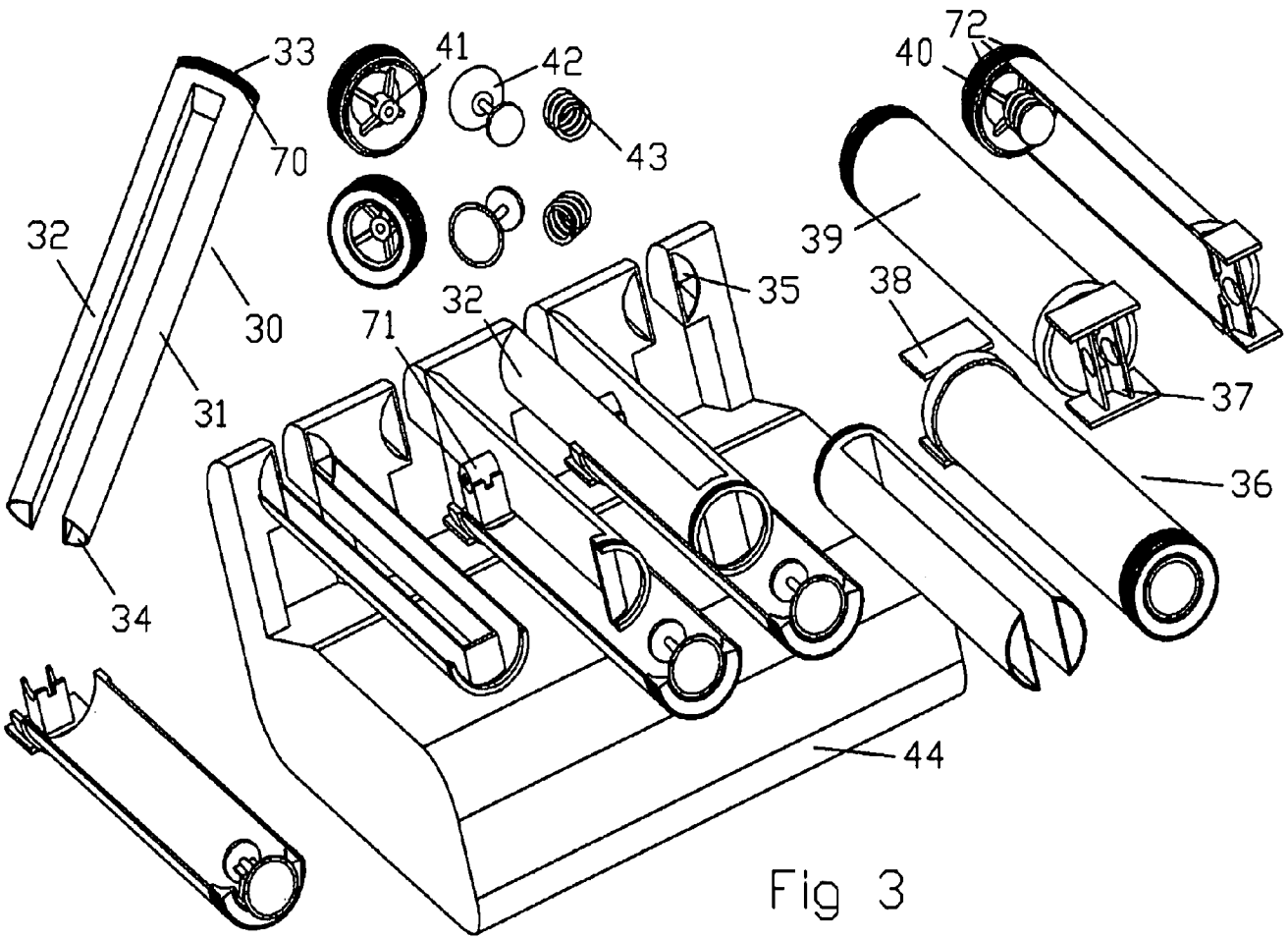
FIG. 3 shows details of the plenum, of the pants and of the pistons of the engine of FIG. 2. The parts are shown from various view points, some complete, some others sliced.

Instead of the intake ports of the prior art, the engine of FIGS. 2, 3 comprises an intake poppet valve 42 seated onto the piston crown 40, and instead of the piston rod of the prior art, the engine of FIGS. 2, 3 comprises a piston skirt 39 connecting the piston crown 40 with the crosshead 37, 38 and transferring the combustion and inertia loads. A reverse U shaped shell 30, like pantaloons and referred as shell or "pants" in the following, isolates the space underside the piston crown from the crankcase, allowing the connecting rod to move between the two pant-legs 31, 32 without collision and forms the ports 34 through which air is fed from the intake plenum 44 to the space underside the piston crown, i.e. to the space between the shell 30 and the piston crown 40.

Between the external surface of the piston skirt and the cylinder liner there is a gap preventing the piston skirt from touching the cylinder liner and providing space for the oil scrapped by the piston scraper ring to return back to the crankcase. The space between the piston skirt and the cylinder liner, as well as the space between the piston skirt and the pants below the rings on the pants, are connected, i.e. communicate, with the oil pan. The bigger external diameter of the piston skirt near the crosshead is allowing better support of the piston skirt onto the crosshead and is avoiding deformations.

At the end of the expansion the exhaust valve opens and the pressure drops. Later the intake valve, abutting on the "pants", decelerates and stops moving, while the piston 36 continues its motion downwards. The intake valve opens and the scavenging starts. Air from the plenum, through the pant-legs and through the piston crown, enters and scavenges the cylinder. Later the exhaust valve closes. Air continues to enter the cylinder through the intake valve until the intake piston, moving upwards, makes the intake valve to land onto the valve seat on the piston crown; initially the restoring spring 43 of the intake valve, and later the pressure into the combustion chamber, keep the valve closed and provide the necessary force to the valve to follow the piston motion during the compression, the combustion and the expansion.

Compression rings and oil scrapper rings mounted on the piston crown and abutting onto the, rid of ports, cylinder liner seal the combustion chamber and control the lubricating oil as in the four-stroke trunk piston engine: the cylinder liner is virtually over-lubricated with an oil scraper ring on the piston scraping the surplus oil back to the oil pan, from where it is drained, cleaned and recycled.

Seals (or rings) mounted on grooves (or ring-lands) at the top 33 of the pants 30 are slidably fitted onto the internal surface of the piston skirt, sealing the crankcase from the space underside the piston crown and scraping the lubricating oil back to the oil pan. The air passing through the piston cools the piston crown and the ring-lands.

Figure 4:
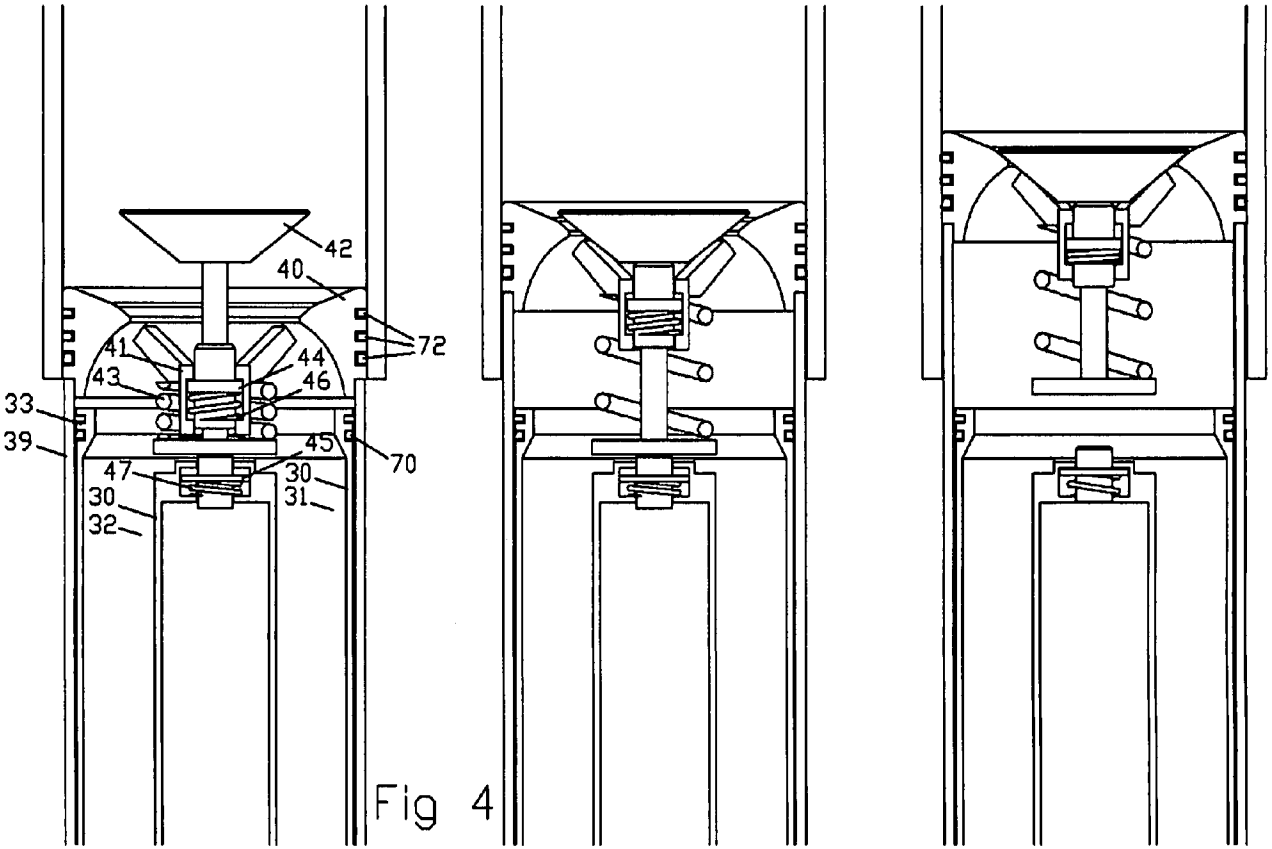
FIG. 4 shows details of a shock absorber mechanism for the smooth landing of the intake valve.

A dumper 45, 47, FIG. 4, can smooth out the landing of the valve 42 on the pants 30: the dumper, which here is a double acting piston inside an oil cylinder (like the conventional shock absorbers), is mounted at the top end of the pants waiting the valve stem to land on it. At left the piston 39, 40, 41 is at the BDC and the dumper piston is compressed downwards; the oil from the lower side of the dumper piston, during the deceleration of the valve 42, has been moved to the upper side. At right the dumper piston is restored at its uppermost position waiting to decelerate, without impact loads and noise, the valve at the next valve landing on the pants.

In a similar way a dumper 44, 46 can smooth out the landing of the valve 42 on the valve seat: the dumper interposed between the valve guide 41 and the valve 42, as shown in FIG. 4, accelerates the valve to land smoothly on the crown of the upwards moving piston, avoiding impact loads and noise. At left the valve is widely open. At the middle the valve is about to close; the valve is already landed onto the dumper 44, 46 displacing oil from the lower side to the upper side of the dumper cylinder and receiving a reaction force that accelerates upwards the valve before its landing onto the piston crown 40. At right the valve is closed; the dumper piston is at its lowermost position and remains there until the next landing of the valve on the pants.

Various types of dumpers can be used, like oil shock absorbers, soft washers etc.

Figure 5:
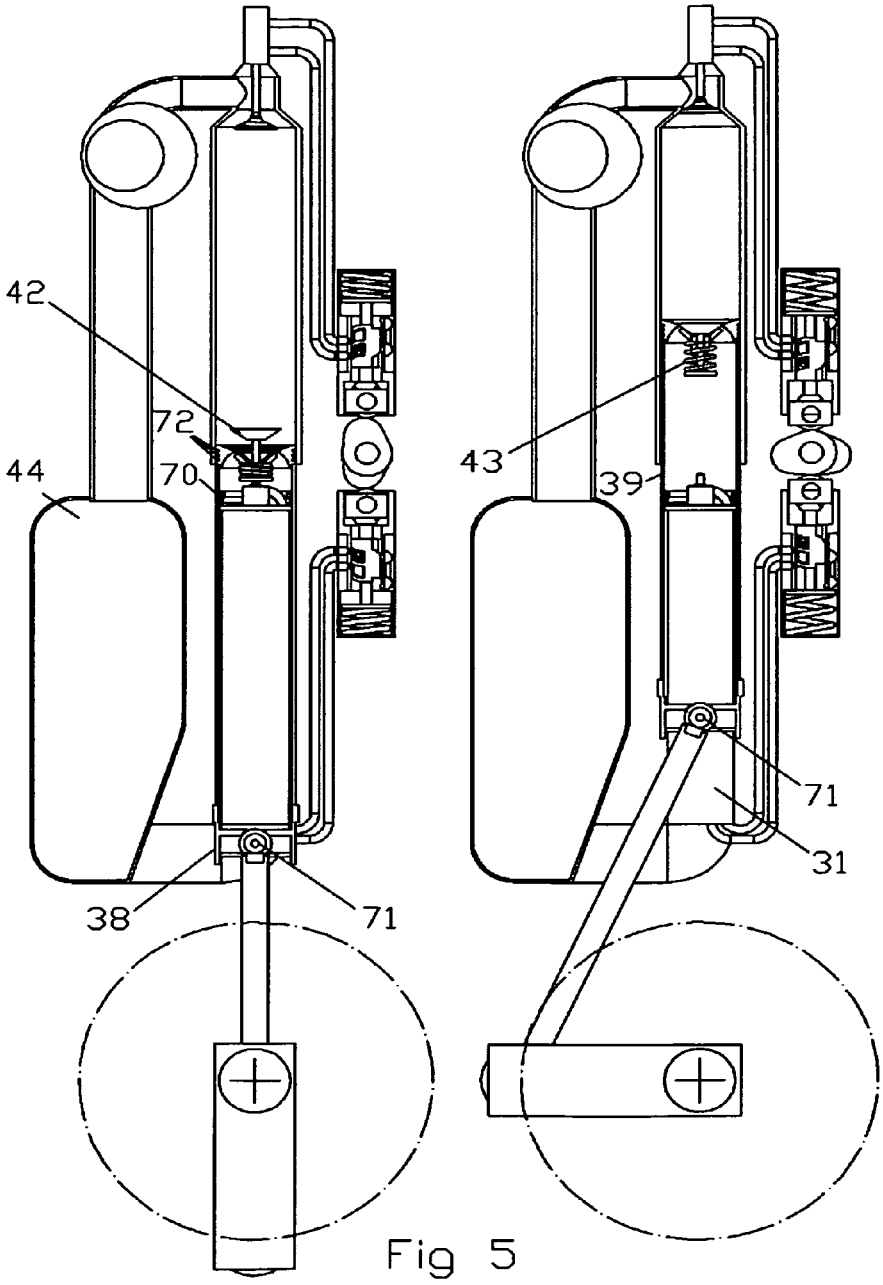
FIG. 5 shows a version of the first embodiment wherein the HyDesmo system controls the motion of the intake and of the exhaust valves.

FIG. 5 shows, at two crankshaft angles, another version of the first embodiment. In this version the HyDesmo system, a Hydraulic Desmodromic VVA, controls the motion of the intake and of the exhaust valves. Besides the smooth landing of the valves, the HyDesmo system enables infinite valve lift profiles to adjust the engine operation with the operational conditions (revs, load, temperature etc). The camshaft actuates the oil piston of the HyDesmo. The oil piston displaces oil. The oil, through proper piping, displaces the valve piston that actuates the exhaust valve to open and to close. In the case of the intake valve that travels with the piston, the HyDesmo actuates a pin wherein the intake valve lands when the piston approaches the BDC; the HyDesmo actuates the pin at the intake valve opening so that the moment the intake valve lands on it, the pin motion and the intake valve motion match, eliminating the impact loads and the noise. The HyDesmo actuates the pin and at the intake valve closing so that the moment the valve lands onto the piston crown, the pin motion and the piston motion match. As shown in FIG. 5, the piping for the actuation of the intake valve passes through the pant-legs. In FIG. 5 the HyDesmo is shown well oversized, while the engine casing and the crosshead guides are not shown.

The architecture of the first embodiment combines the advantages of the long-stroke uniflow two-stroke engine with the elimination of their disadvantages. Among these disadvantages are: the increased running cost (the cylinder liner lubricant is expensive and is burned/lost in the "once-through" lubrication used), the higher maintenance cost (shorter overhaul intervals due to decreased scuffing resistance), the exhaust gas emission, the need for external separate cylinder lubricating device that supplies the lubricating oil via quills in the cylinder liner.

In a second embodiment, FIGS. 6 to 9, a camshaft rotating in synchronization to the crankshaft, controls the intake valve motion. The rid-of-ports cylinder liner is practically over-lubricated with an oil scraper ring on the piston scraping the surplus oil back to the oil pan. The working medium is isolated from the crankcase lubricant as the working medium of the conventional four-stroke is isolated from the crankcase lubricant.

The connecting rods are disposed at the two sides of the cylinder, outside the cylinder footprint, to rid the piston underside space of obstacles like a piston pin and a connecting rod, in order to free the flow of the working medium and to make space for the intake valve actuator and its mechanism.

The piston comprises valve seats and valve guides. The piston bears intake poppet valves and restoring springs. The exhaust valves are controlled conventionally, for instance by cams secured to the crankshaft. An intake camshaft rotates in synchronization with the crankshaft by means of sprockets, gears etc. A valve actuator is displaced by the intake camshaft and is restored by restoring springs. During the compression, the combustion and the expansion, the intake valves move together with the piston. The right moment the exhaust valves open and the pressure inside the cylinder drops. At a crankshaft angle, the intake valves land on the valve actuator and start following its motion. Compressed air from the piston underside space enters the cylinder, through the ports/holes on the piston crown, and scavenges the exhaust gas. The right moment the exhaust valves close. Compressed air continuous to enter the cylinder until the intake valves land on the valve seats on the piston crown and start following the piston motion. The compression begins.

A good intake cam-lobe has to allow the intake valves to pass smoothly, quietly and reliably from the motion with the piston to the motion with the valve actuator (and vice versa); a good intake cam-lobe has also to protect the intake poppet valves, and their restoring springs, from extreme valve lifts.

Figure 6:
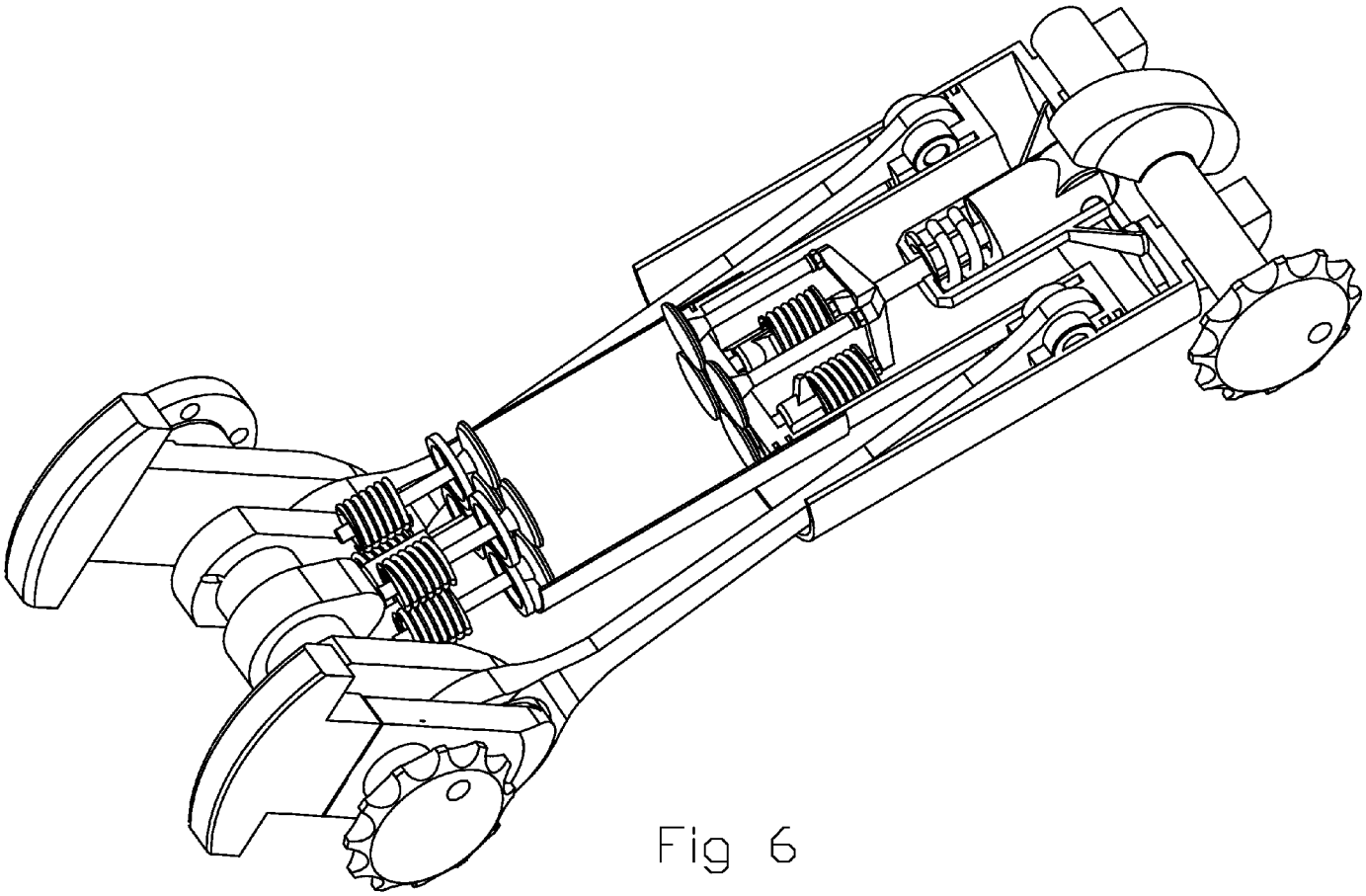
FIG. 6 shows a second embodiment. The combustion happens in the inner cylinder; the external cylinder takes the thrust loads.
Figure 7:
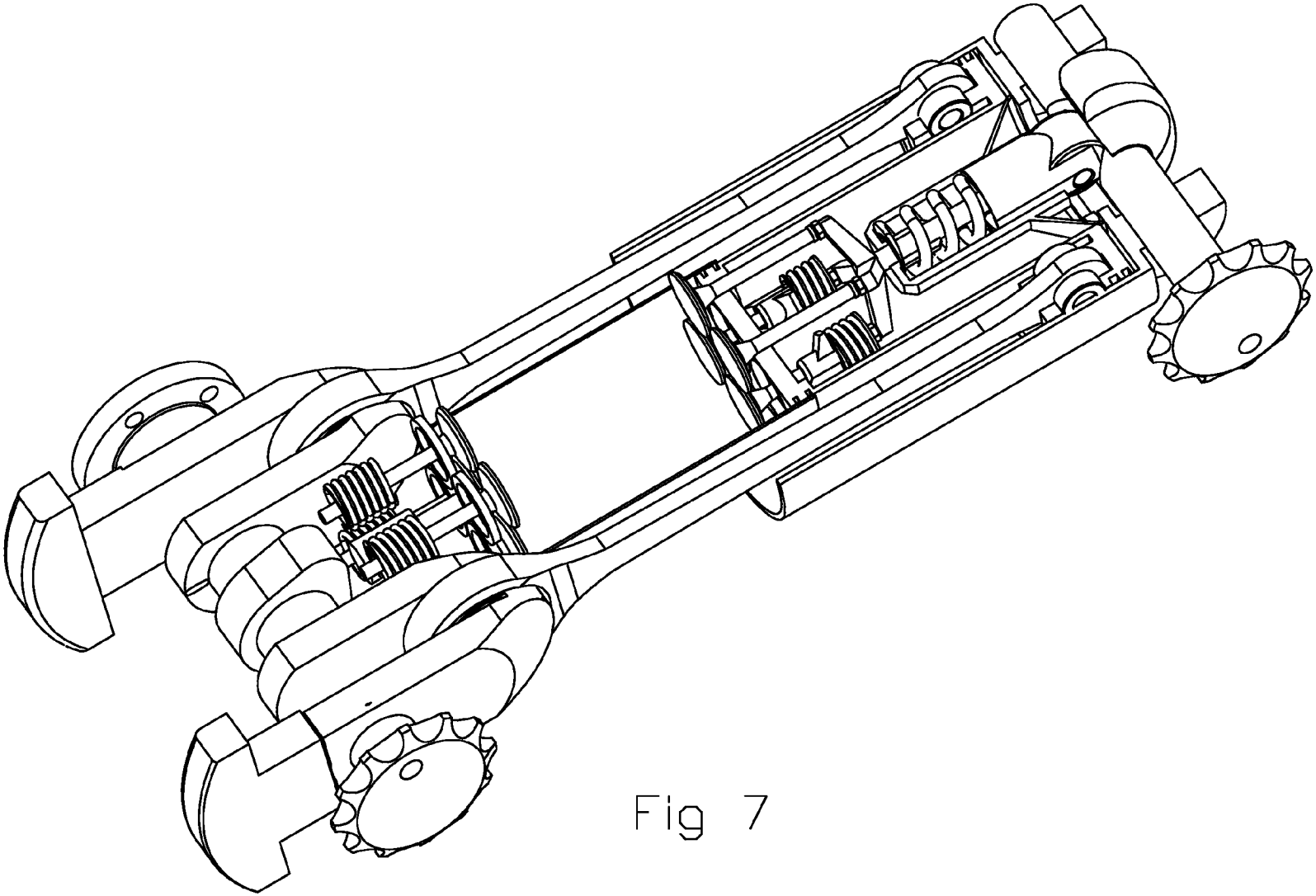
FIG. 7 shows the engine of FIG. 6 at another crank angle.
Figure 8:
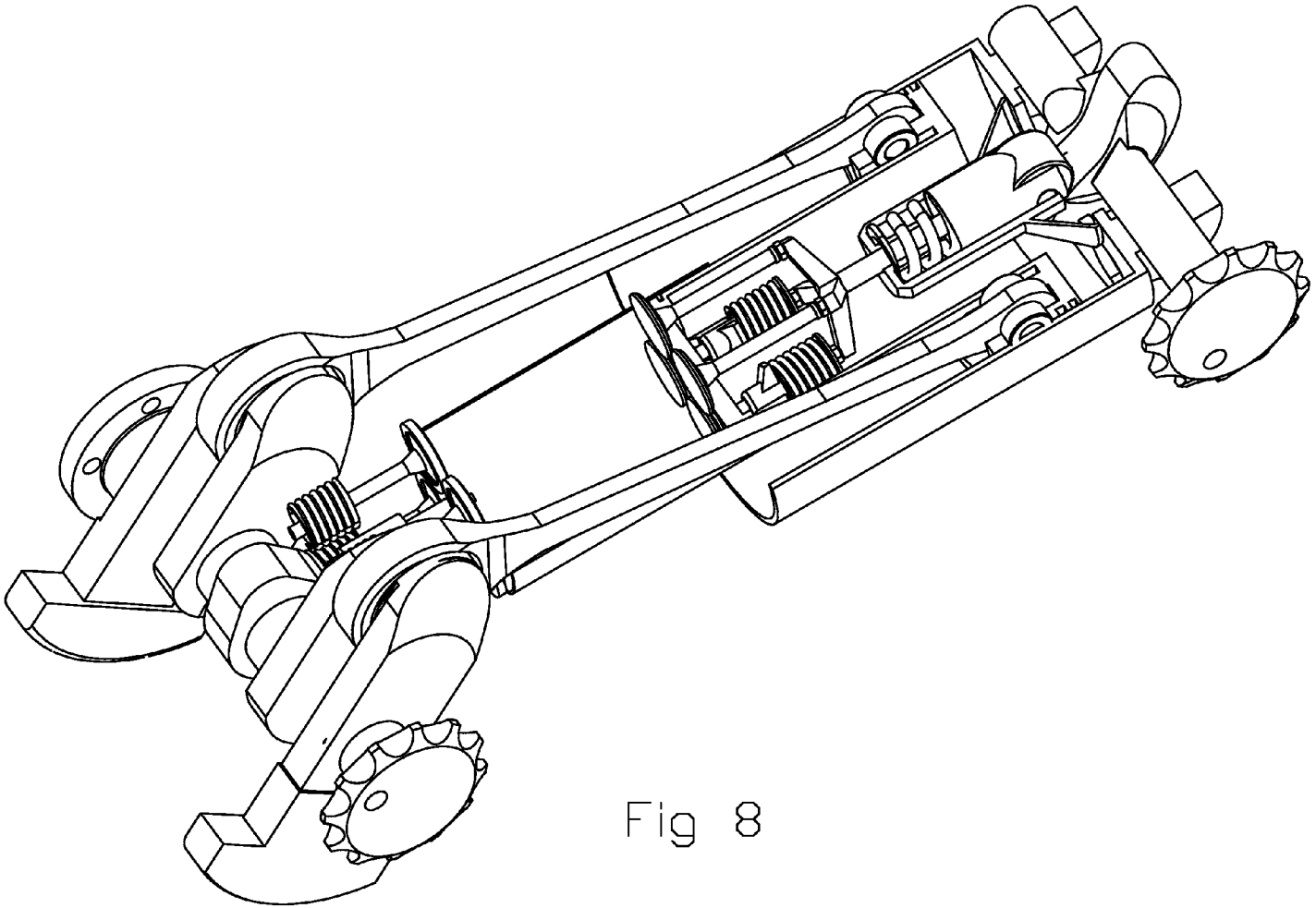
FIG. 8 shows the engine of FIG. 6 at another crank angle.
Figure 9:
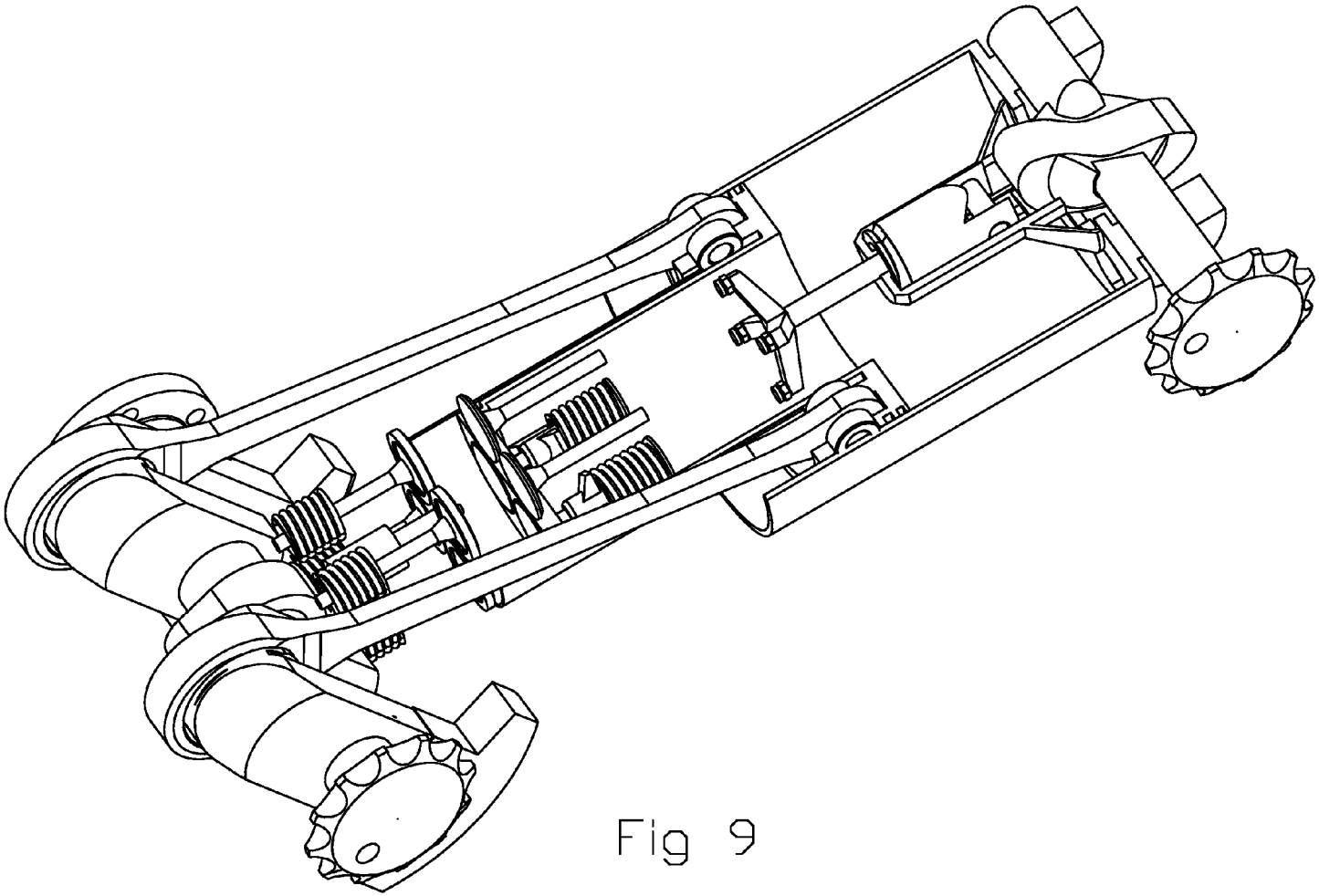
FIG. 9 shows the engine of FIG. 6 at another crank angle.

In FIG. 6 the crankshaft is at 135 degrees after the TDC; the exhaust valves are widely open; the intake valves have started opening. In FIG. 7 the crankshaft is at 180 degrees after the TDC; the intake valves are widely open, while the exhaust valves have started closing. In FIG. 8 the crankshaft is at 225 degrees after the TDC; the intake valves are only slightly open, near to their valve seats on the piston crown; in a few degrees the piston will gently take them up from the valve actuator. In FIG. 9 the crankshaft is at 300 degrees after the TDC; the restoring springs and the pressure inside the cylinder decelerate the intake valves, keeping them firmly onto their valve seats on the piston crown.

Figure 10:
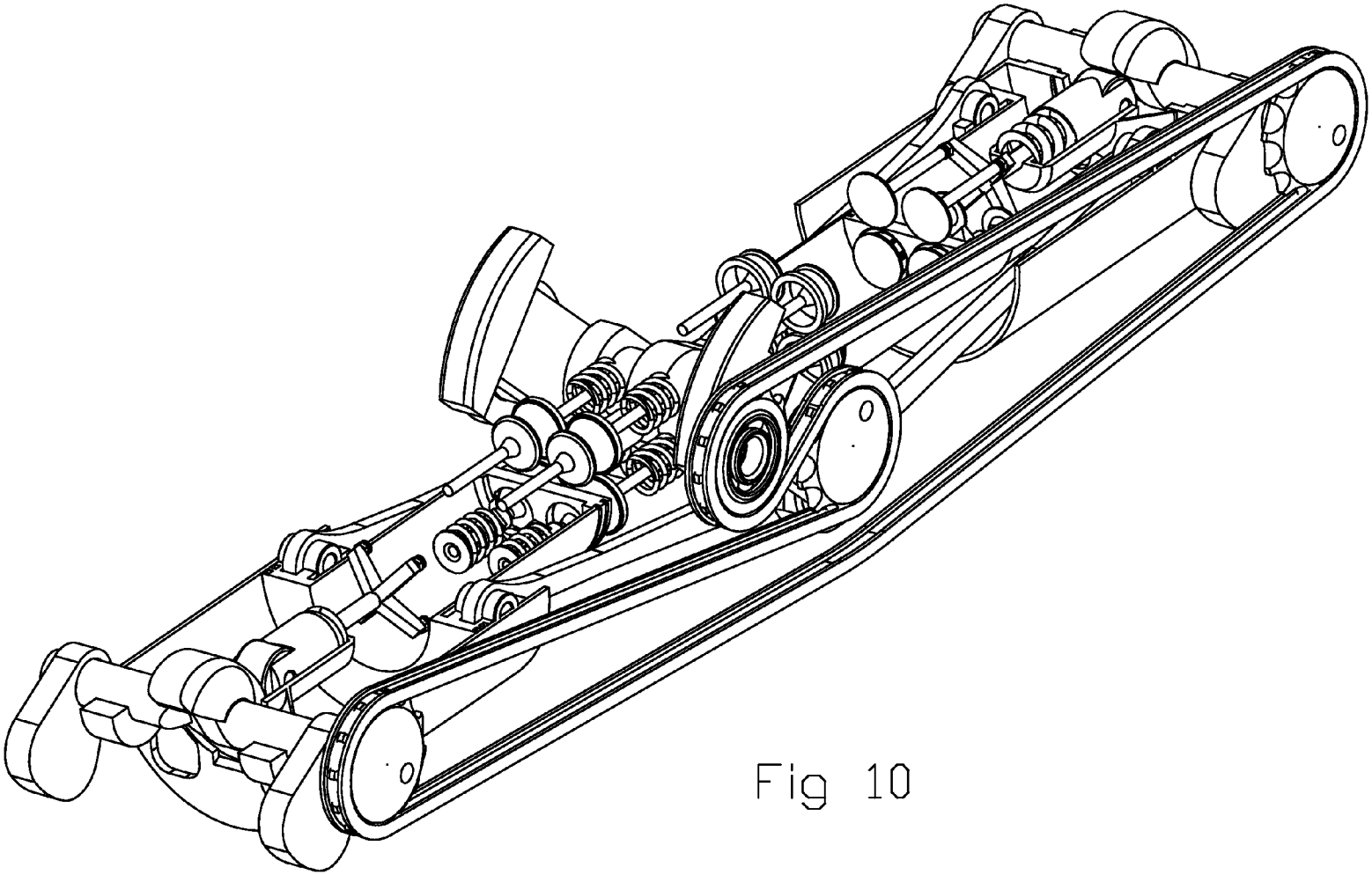
FIG. 10 shows a flat engine according the second embodiment.

By counterweights secured on the two intake camshafts, the inertia forces of the even firing opposed cylinder version of this engine, shown in FIG. 10, are full balanced.

Figure 11:
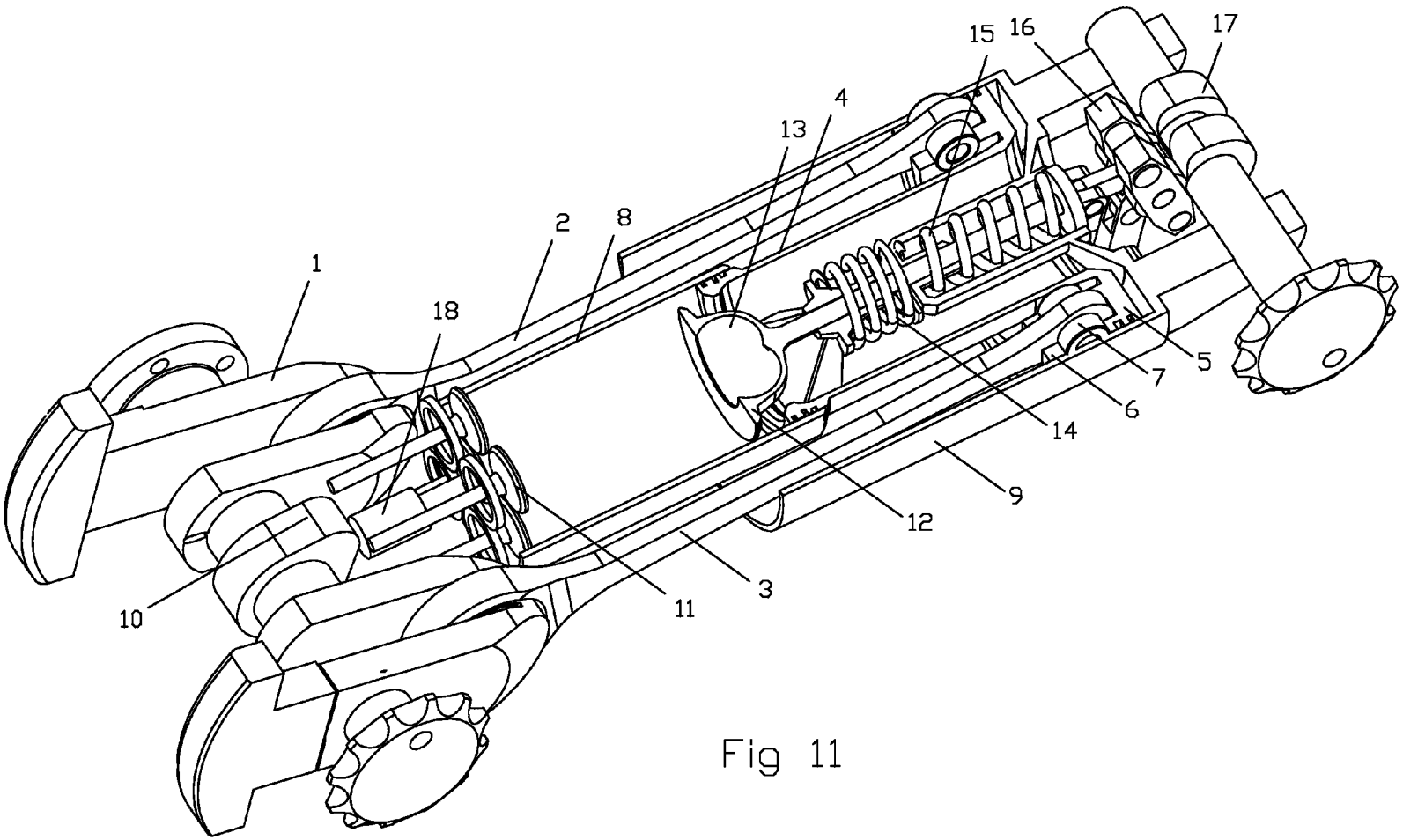
FIG. 11 shows a third embodiment wherein there is one intake valve per piston with the combustion bowl formed inside the intake valve.

In a third embodiment, FIG. 11, there is only one intake valve 12 per piston 4. The combustion bowl 13 is formed inside the intake valve 12. A double rocker arm 16 multiplies the camming action of the intake camlobe 17 and reduces the friction.

Figure 12:
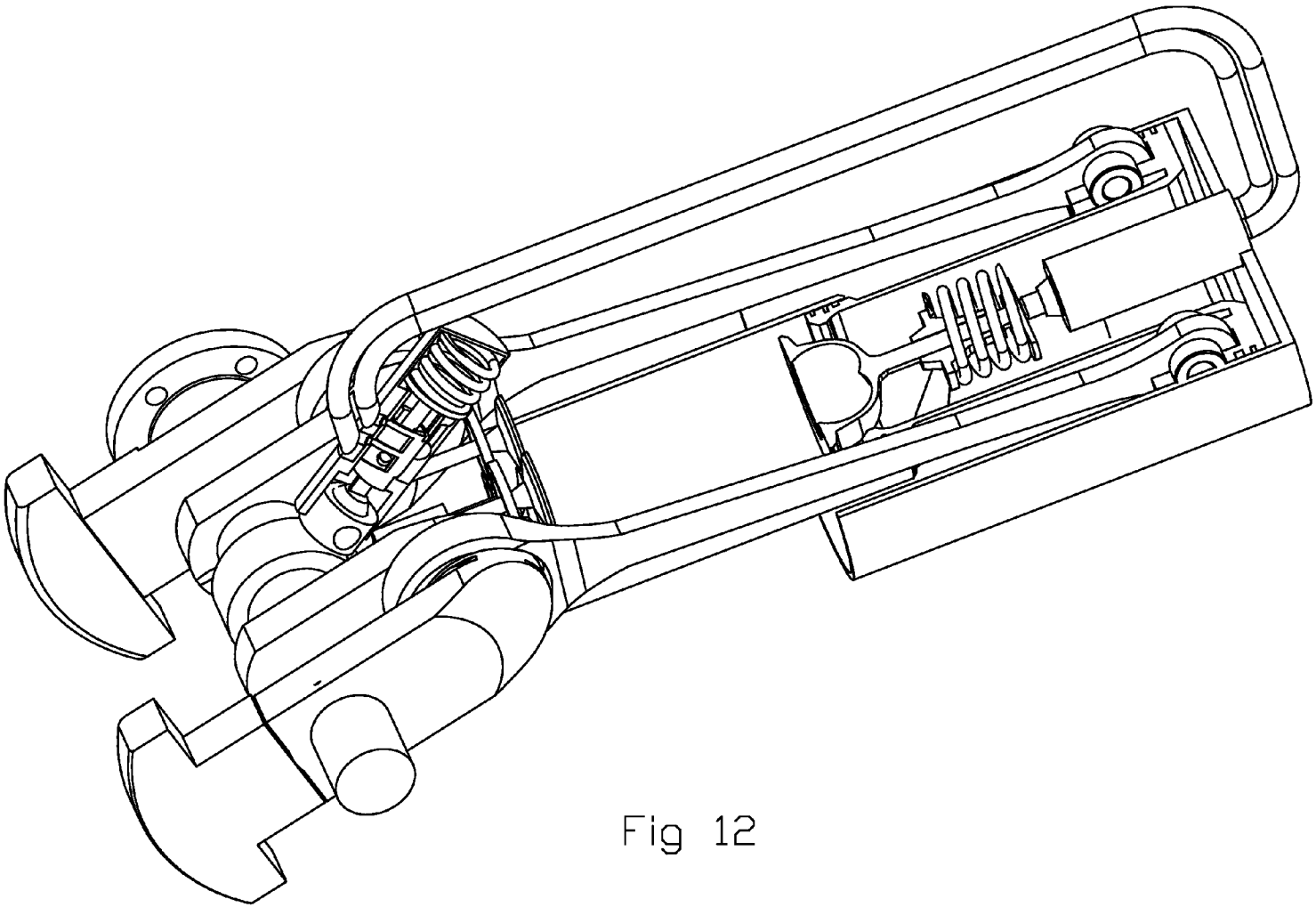
FIG. 12 shows a fourth embodiment. The HyDesmo system is used to actuate the intake valve.

In a fourth embodiment, FIG. 12, the intake valve is actuated by the HyDesmo mechanism, resulting in lower engine height and simpler construction. The intake cam can be mounted near the crankshaft; alternatively, the cam lobe at the middle of the crankshaft can actuate, through the HyDesmo, the intake valve. The inbuilt leverage of the HyDesmo and the absence of restoring valve springs make things simpler. The HyDesmo, based on a liquid to transfer the motion to the valve, fits better to impact loads reduction and to smoother and quieter landing of the valves. The HyDesmo system can also control the exhaust valves, providing full control over the engine breathing.

Figure 13:
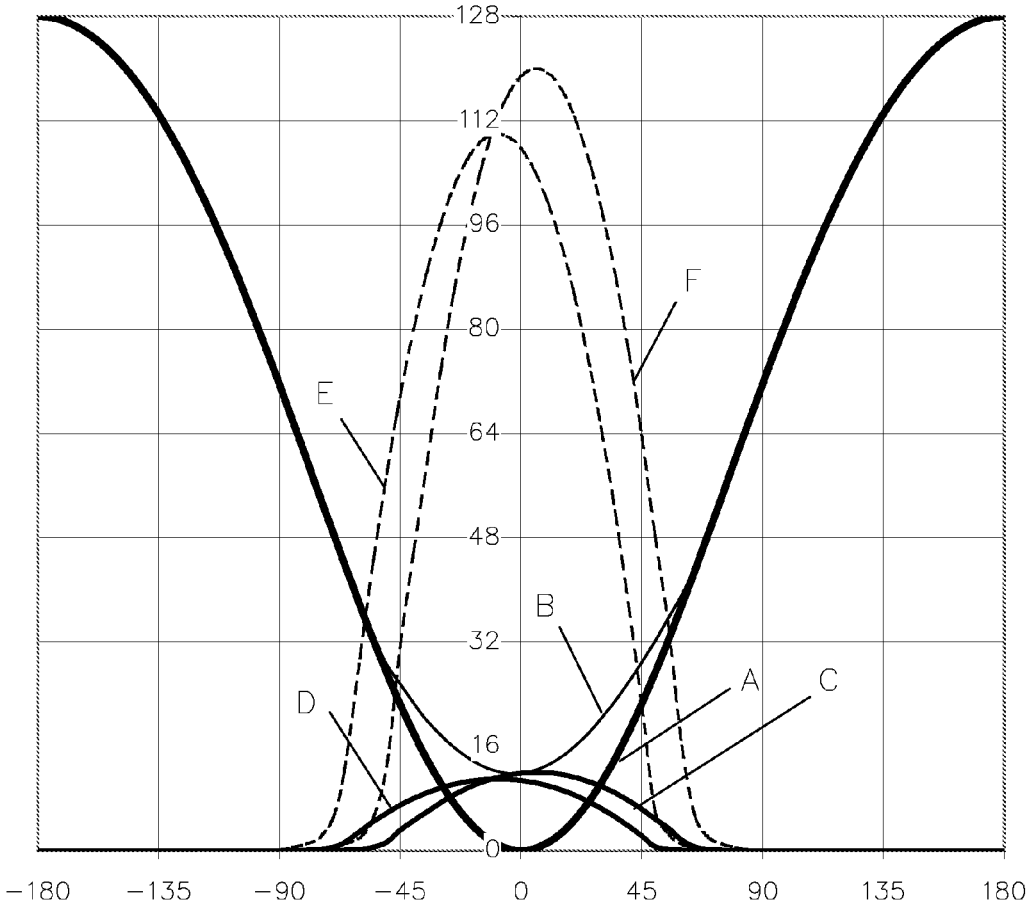
FIG. 13 shows the piston and valve position versus the crank angle.
Figure 14:
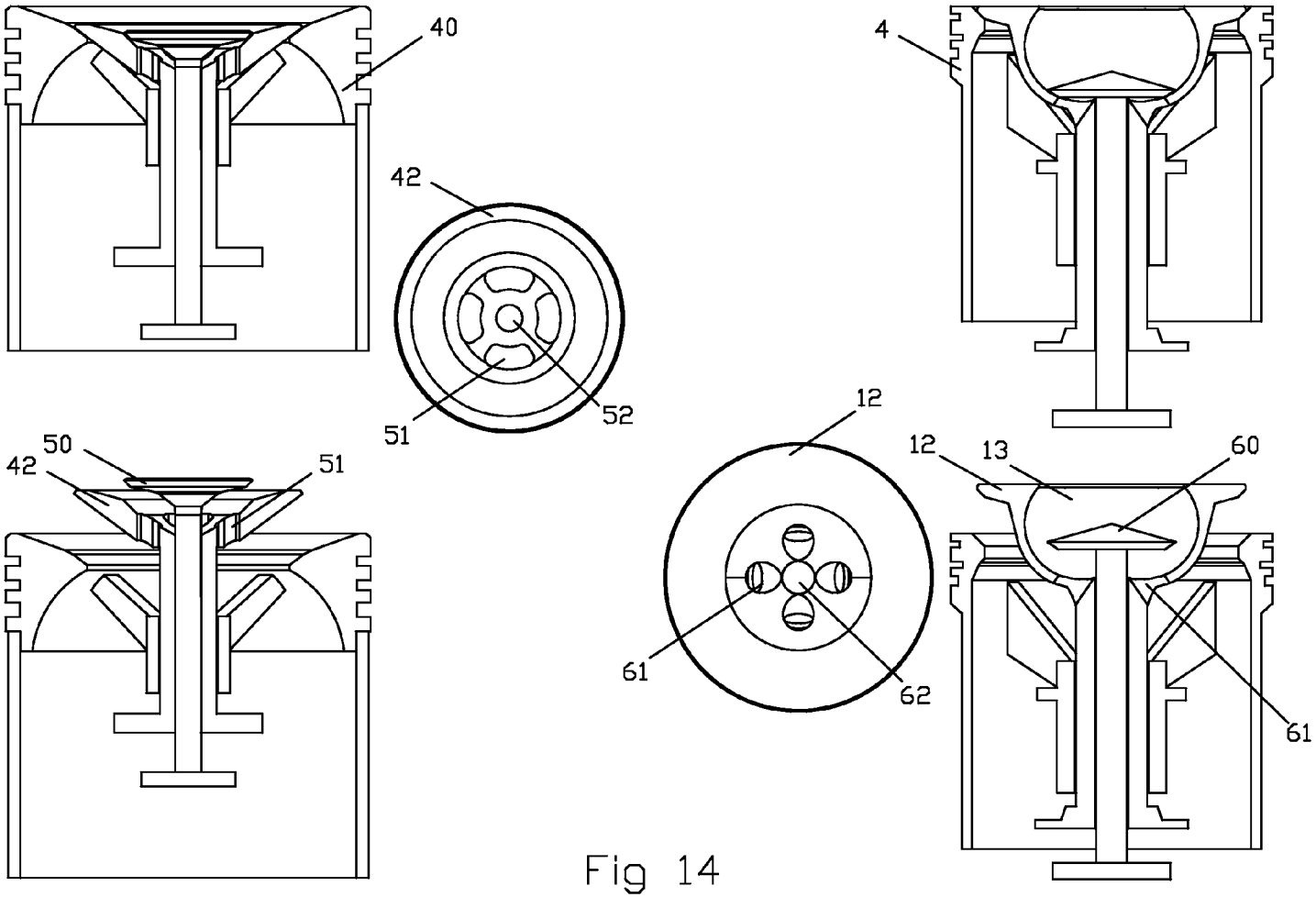
FIG. 14 shows, at left, a variation of the first embodiment and, at right, a variation of the second embodiment.

FIG. 13 shows an indicative piston-motion vs crankshaft-angle plot (curve A, fat line) for engines like those in FIGS. 5 to 12; it also shows the absolute intake valve motion (curve B); for many degrees the intake valve moves together with the piston, as a body, and the curve B stays "inside" the curve A. The same plot shows the intake valve lift (curve C, continuous line); it is the motion of the intake valve relative to the piston motion. The same plot shows the exhaust valve lift (curve D, continuous line). The dash-line curve E is the exhaust valve lift magnified by ten times; the dash-line curve F is the intake valve lift magnified by ten times. FIG. 14, left, shows a secondary intake valve 50 slidably fitted into the intake valve 42 of the first embodiment. During the scavenging, the ports 51 on the intake valve 42, and the open valve 50, provide additional passages for the air to scavenge the cylinder and to better clean the core of the residual gas. At top left both intake valves are closed, at bottom left both intake valves are open.

FIG. 14, right, shows a secondary intake valve 60 slidably fitted into the intake valve 12 of the fourth embodiment. During the scavenging, the ports 61 on the intake valve 12, and the open valve 60, provide additional passages for the working medium to scavenge the cylinder and to better clean the combustion bowl and the cylinder from the residual gas, and to cool the bowl. At top right the intake valves are closed, at bottom right the intake valves are open.

Although the invention has been described and illustrated in detail, the spirit and scope of the present invention are to be limited only by the terms of the appended claims.

What is claimed is:

1. A through-scavenging two-stroke engine comprising at least:

a crankcase;

a cylinder forming a combustion chamber therein, the cylinder is mounted on the crankcase;

a cylinder head sealing one side of the combustion chamber, the cylinder head is comprising an exhaust port and an exhaust poppet valve controlling the exhaust port;

a crankshaft rotatably mounted to the crankcase;

a connecting rod;

a piston reciprocally disposed into the cylinder, the piston is sealing another side of the combustion chamber;

the piston is comprising a piston skirt, a piston crown secured at one end of the piston skirt and a wrist pin secured at the other end of the piston skirt;

the piston skirt is having an outer surface adjacent the cylinder and an inner surface;

the connecting rod is pivotally mounted to the piston by the wrist pin, the connecting rod is drivingly coupling the piston to the crankshaft;

a substantially immovable shell is disposed inside the piston skirt between the piston crown and the wrist pin so that the wrist pin and the piston crown move at opposite sides of the substantially immovable shell;

the inner surface of the piston skirt is reciprocally disposed around the substantially immovable shell;

the piston crown is comprising an intake port and an intake poppet valve having a restoring valve spring;

the intake poppet valve is controlling the intake port;

the combustion chamber is communicating, through the intake port, with a space underside the piston crown;

the space underside the piston crown is being inside the piston skirt between the piston crown and the substantially immovable shell;

the substantially immovable shell is comprising a port feeding air or mixture to the space underside the piston crown;

the space underside the piston crown is sealed from the crankcase; and an oil scraper is scrapping most of the oil supplied to the inner surface of the piston skirt back to the crankcase from where it is cleaned and recycled.

2. The through-scavenging two-stroke engine, according claim 1, wherein:

the engine is a crosshead engine;

the piston skirt is connecting the piston crown with the crosshead.

3. The through-scavenging two-stroke engine, according claim 1, wherein:

the piston is having a set of piston rings slidably fitted to the cylinder;

the set of piston rings is sealing the combustion chamber from the crankcase;

the surface of the cylinder wherein the set of piston rings slide is rid of ports.

4. The through-scavenging two-stroke engine, according claim 1, wherein:

the oil scraper is mounted on the substantially immovable shell, the oil scraper is slidably fitted onto the inner surface of the piston skirt;

there are more than one ports feeding air or mixture to the space underside the piston crown;

the more than one ports are sealed from the crankcase centrally by the oil scraper so that the shape and the size and the flow capacity of each port is not limited by the need of having its own sealing means;

wherein so that the overall flow capacity through the ports towards the space underside the piston crown is increased;

wherein so that the sturdiness of the ports structure is substantially improved;

wherein so that the control over the lubricant is more efficient, reliable and cheap.

5. The through-scavenging two-stroke engine, according claim 1, wherein:

the substantially immovable shell is a pants-shaped shell mounted on the crankcase;

the connecting rod moves between the legs of the pants-shaped shell;

the piston skirt is reciprocally disposed outside the pants-shaped shell;

sealing means on the pants-shaped shell seal the crankcase from the space underside the piston crown;

the inner surface of the piston skirt along which the sealing means slide, is rid of ports.

6. The through-scavenging two-stroke engine, according claim 1, wherein:

the oil scraper is an oil scraper ring mounted in a groove of the substantially immovable shell;

the oil scraper ring is slidably fitted onto the inner surface of the piston skirt;

a volume is defined inside the piston skirt between the piston crown and the oil scraper ring;

the volume depends on the crankshaft angle and is substantially variable having a maximum comparable to the per cylinder capacity of the engine and a minimum several times smaller;

wherein, during the compression stroke of the piston the volume increases progressively creating a vacuum and causing a substantial quantity of air or mixture, which is sealed from the crankcase, and to enter and fill the volume, during the expansion stroke of the piston, the volume decreases progressively enabling a built in scavenging pump that adds neither complication, nor cost, nor mechanical friction to the engine.

7. The through-scavenging two-stroke engine, according claim 1, wherein:

the substantially immovable shell is a pants-shaped shell mounted on the crankcase;

air or mixture through the legs of the pants-shaped shell enters initially into the space underside the piston crown and, when the intake poppet valve opens, it enters into the cylinder through the intake port.

8. The through-scavenging two-stroke engine, according claim 1, wherein:

the substantially immovable shell is a wall comprising a pair of ports with the connecting rod moving between the pair of ports.

9. The through-scavenging two-stroke engine, according claim 1, wherein:

the substantially immovable shell is a pants-shaped shell mounted on the crankcase;

at a crankshaft angle the intake poppet valve lands onto the pants-shaped shell and opens the intake port allowing the communication of the combustion chamber with the space underside the piston crown;

at another crankshaft angle the intake poppet valve lands onto the piston crown and closes the intake port;

shock absorber mechanisms cushion and smooth the landing of the intake valve onto the substantially immovable shell and onto the piston crown.

10. A through-scavenging two-stroke engine, according claim 1, wherein:

the inner surface of the piston skirt is cylindrical;

the oil scraper is an oil scraper ring mounted in a groove of the substantially immovable shell, the oil scraper is slidably fitted onto the inner surface of the piston skirt;

the inner surface of the piston skirt is having a diameter bigger than half of the bore of the cylinder; and the distance of the wrist pin from the piston crown is bigger than the stroke of the piston.

11. The through-scavenging two-stroke engine, according claim 1, wherein:

the opening and the closing of the intake poppet valve of the piston crown is controlled by a hydraulic valve actuation system.

12. The through-scavenging two-stroke engine, according claim 1, wherein:

the intake poppet valve on the piston crown is controlled by a hydraulic variable valve actuation system so that the crankshaft angle wherein the intake poppet valve opens and the crankshaft angle wherein the intake poppet valve closes vary substantially allowing the optimization of the engine operation at the various operational conditions and enabling an easy control over the actual compression ratio of the engine.

13. The through-scavenging two-stroke engine, according claim 1, wherein:

the piston is comprising a set of piston rings;

the crankcase lubricant is lubricating the piston and the set of piston rings;

the piston rings are controlling the lubricant leakage from the crankcase to the combustion chamber as in the four-stroke trunk piston engines;

the crankcase lubricant is also lubricating the wrist pin and the inner surface of the piston skirt that faces the crankcase;

the oil scraper is controlling the lubricant leakage from the crankcase to the space underside the piston crown as in the four-stroke trunk piston engines, so that the specific lube consumption and the scuffing resistance of the engine are comparable to, if not better than, the specific lube consumption and the scuffing resistance of the state of the art four-stroke trunk piston engines.

* * * * *